United States Patent [19]

Landron et al.

[11] Patent Number: 4,677,406

[45] Date of Patent: Jun. 30, 1987

[54] PROTECTIVE SWITCHING APPARATUS

[75] Inventors: Jacques Landron, Messigny et Vantoux; Christian Pichard, Dijon, both of France

[73] Assignee: La Telemecanique Electrique, France

[21] Appl. No.: 808,127

[22] Filed: Dec. 12, 1985

[30] Foreign Application Priority Data

Dec. 13, 1984 [FR] France ..... 84 19043

[51] Int. Cl.[4] ..... H01H 75/12

[52] U.S. Cl. ..... 335/35; 335/23; 335/171; 335/191

[58] Field of Search ..... 335/21-23, 335/35, 169-171, 191

[56] References Cited

U.S. PATENT DOCUMENTS 2,426,880 9/1947 Jackson et al. ..... 335/23
3,500,266 3/1970 De Torre ..... 335/23
3,706,057 12/1972 Ellenberger ..... 335/23
4,472,701 9/1984 Bellows et al. ..... 335/191
4,550,300 10/1985 Jencks et al. ..... 335/22 X

*Primary Examiner*—Arthur T. Grimley
*Assistant Examiner*—Jane K. Lau
*Attorney, Agent, or Firm*—William A. Drucker

[57] ABSTRACT

A protective switching apparatus is provided comprising in an insulating case an interruptible current path in which cooperating contacts are disposed, one of which is fixed and the other is mobile in response to the actuation of a tripping member. The mobile contact is disposed at a first end of a contact holder arm whose second end is associated with a retractable fulcrum forming the output member of the lock, the contact holder arm being subjected to the action of a resilient quick opening means and to the action of a resilient closure means. The contact holder arm is mounted without fixed fulcrum, so as to pivot either by bearing against a bearing surface of the toggle joint during tripping on a fault, or against a bearing surface of the retractable fulcrum of the lock during voluntary manual or automatic tripping.

7 Claims, 11 Drawing Figures

PROTECTIVE SWITCHING APPARATUS

BACKGROUND OF THE INVENTION

1. Field of the Invention

The present invention relates to protective switching apparatus of the circuit breaker kind, comprising in an insulating case an interruptible current path in which cooperating contacts are disposed, one of which is fixed and the other of which is mobile in response either to the actuation of a member tripping on a fault of electromagnetic and/or thermal origin via a lock, or to the actuation of a voluntary tripping and resetting member such as a lever via a toggle joint mechanism.

2. Description of the Prior Art

Circuit breakers of this type are known more especially from the U.S. Pat. No. 2 352 517. In these circuit breakers, the mobile contact is disposed at a first end of a contact holder arm whose second end is associated with a retractable support forming the output member of the lock, the contact holder arm being subjected to the action of a quick opening and closure resilient means; the contact holder arm is mounted without a fixed fulcrum point, so as to pivot either by bearing on a surface of the toggle joint mechanism during tripping on a fault, or on a surface of the retractable support of the lock during voluntary manual or automati c tripping.

The resilient quick opening and closure means is then formed by a member applicable, on the one hand, against the contact holder arm at a point thereof situated between its second end and its bearing point on the toggle joint mechanism, on the other hand, against the case.

It is more particularly desirable to give to the resilient opening and closure member a simple and compact configuration.

SUMMARY OF THE INVENTION

The aim of the present invention in particular is to simplify the construction of a circuit breaker of the above described type, while giving this circuit breaker a compact shape, particularly in depth.

It also has as aim to simplify the design and construction of the lock, more particularly by a specific arrangement of the resilient opening and closure member.

A further aim, in the circuit breaker using a floating contact holder arm, is to urge this arm and the toggle joint mechanism by simple means avoiding floating of said mechanism.

In accordance with the invention, in an apparatus of the described type, the resilient quick opening and closure member is, on the other hand, applicable against the toggle joint mechanism, said member being formed by a single torsion spring, for example in the form of a hair pin or blade, comprising a first leg bearing against the toggle joint mechanism and a second leg bearing against the contact holder arm in the direction of opening for the case of tripping on a fault the spring being disengageable at the end of opening of the mobile contact by abutment of its first leg against its second leg.

The resilient urging of the contact holder arm is thus achieved in a particularly simple and compact way; in particular, the legs of the hairpin or blade spring may extend substantially parallel to the front face of the case.

BRIEF DESCRIPTION OF THE DRAWINGS

Other features and advantages of the invention will be clearer from reading the following description. In the accompanying drawings.

Figure 2:
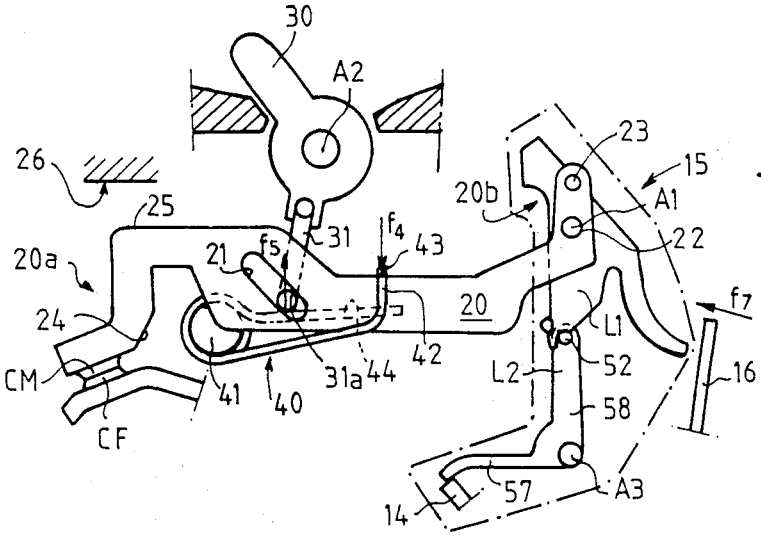
FIG. 2 shows a part of the control mechanism of the circuit break of FIG. 1 in the engaged position.
Figure 3:
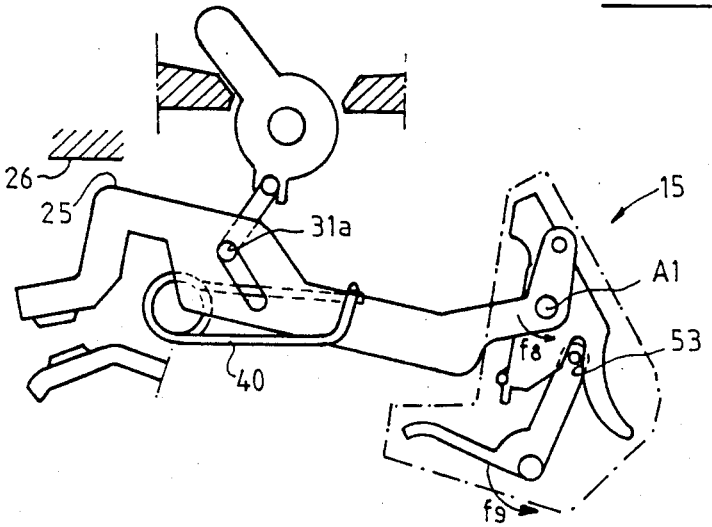
Figure 4:
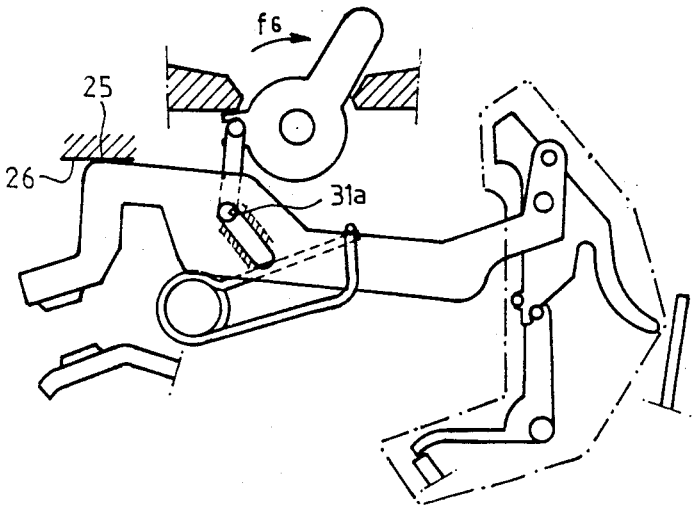
Figure 5:
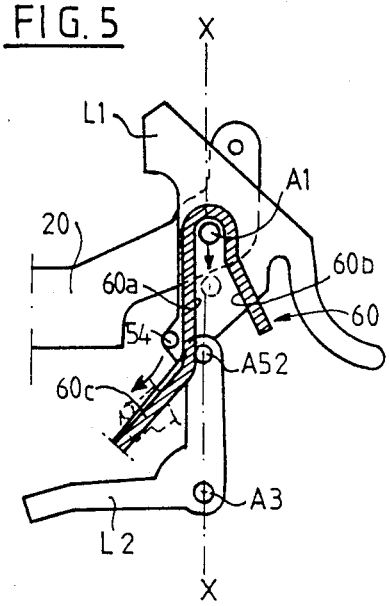
Figure 6:
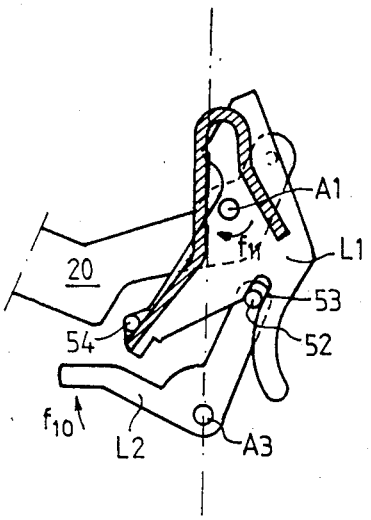
Figure 7:
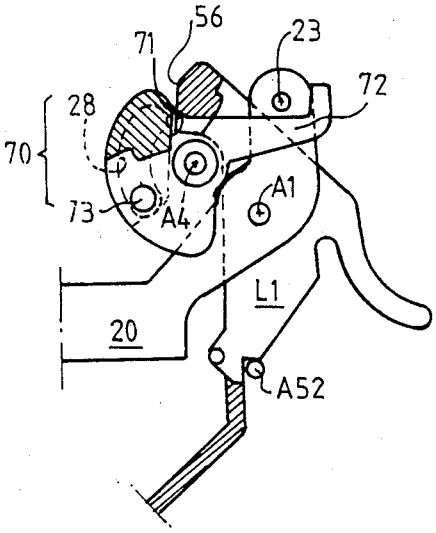
Figure 8:
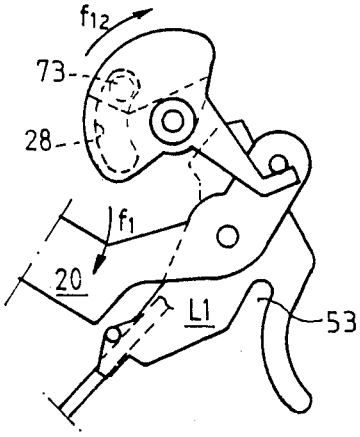

FIGS. *2a, 2b* show two details of the mechanism of FIG. 2;

FIGS. 3 and 4 show the same mechanism respectively in the positions corresponding to tripping on a fault and voluntary tripping;

FIG. *4a* shows a detail of a case of the circuit breaker;

FIGS. 5 and 6 show the broken link associated with the contact holder arm, in the extended and respectively retracted position;

FIGS. 7 and 8 show a coupling piece disposed near the second end of the contact holder arm for cooperating with an adjacent tripping or signalling apparatus.

DESCRIPTION OF THE PREFERRED EMBODIMENTS

The protective switching apparatus illustrated in the Figures is a modular circuit breaker with insulating case 10. The circuit breaker comprises a pair of separable contacts, namely a fixed contact CF and a mobile contact CM disposed in a current path provided in the case between a first terminal 11 and a second terminal 12.

Case 10 comprises an electromagnetic tripping member 13 with mobile active element 14 and a bimetal thermal tripping member 16 capable of actuating a lock 15 for separating the mobile contact CM from the fixed contact CF following a fault such as an over voltage, a short circuit or an over load, appearing at terminals 11 and 12.

The mobile contact CM is carried by a rocker arm 20 without fixed support with respect to the case. The current path formed between terminals 11 and 12 when the circuit breaker is engaged comprises a conductor 17*a*, the winding of the electromagnetic trip 13, a conductor 17*b*, the fixed contact CF, the mobile contact CM, the rocker arm 20, flexible conductor 17*c*, the bimetallic strip 16 and a conductor 17*d*. A voluntary tripping member 30 such as a pivoting lever, a push button or a rotary button is associated with the front face 18 of the case 10 of the circuit breaker, while being connected to the rocker arm 20 by a toggle joint connection 31. It will be noted that the space required in depth by the circuit breaker, i.e. the space between the front face 18 and a rear face 19 provided with means for fixing to a support, is reduced because of the arrangement of the parts housed in the case, more particularly because the rocker arm is disposed substantially parallel to the plane of face 18 in the vicinity thereof, while being connected directly to lever 30 by a toggle joint connection 31 of small height, whereas lock 15 is offset laterally.

The contact holder arm 20 is mounted for floatingly pivoting on pins or pivots whose position with respect to the case is likely to vary; it is further urged by a single hair pin spring 40 adapted and mounted on a fixed pin 41 so as to form a means for the rapid opening and a means for closing the mobile contact CM.

In accordance with the invention, to separate the contacts, (arrow F in FIG. 1), the contact holder arm 20 pivots during tripping on a fault while bearing against a surface 31*a* of the toggle joint mechanism 31 (FIG. 3) and during manual or automatic voluntary tripping by bearing on a surface 22 of lock 15 (FIG. 4).

In the case of a fault, such pivoting occurs about surface 31*a* through lowering of the surface 22 of the lock (arrow f1 in FIG. 1) under the effect of spring 40; in the case of voluntary tripping such pivoting takes place about the surface 22 remaining in the high position (arrow f2 in FIG. 1) through lifting of the arm by means of surface 31*a* itself raised by actuation of the lever under the effect of spring 40 and an assistance spring belonging to lever 30.

In greater detail, the contact holder arm 20 comprises, at a first end 20*a* the mobile contact CM and, near its middle part, a guide slot 21 in which surface 31*a* situated at the end of the toggle joint 31 may slide. Arm 20 is mounted for pivoting near its second end 20*b* to a lever L1 of a broken link L1, L2 by means of a pin with axis A1 determining the above mentioned bearing surface 22; arm 20 has, at its second end 20*b*, a stud 23 which is used for coupling to an adjacent apparatus as will be explained further on.

The contact holder arm 20 has, near the contact CM, an oblique surface 24 contributing to the opening of the mobile contact CM during a tripping procedure in which participate a rotary insulating screen E coming over this surface 24 in the direction of arrow f3 so as to come between the contacts. Arm 20 comprises, finally, towards surface 18 and close to its first end 20*a*, a shoulder 25 capable of cooperating with a stop 26 provided in the case.

Figure 2A:
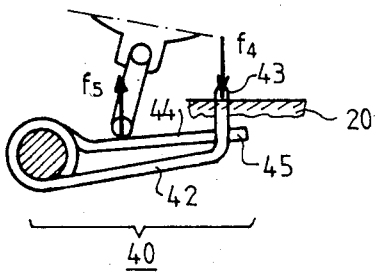
Figure 2B:
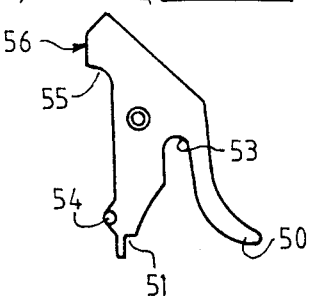

As can be seen in FIGS. 2 and 2*a*, the hairpin spring 40 mounted on pin 41 has a first leg 42, whose transversely bent free end 43 rests on the contact holder arm 20 so as to exert a downward force f4 on the middle zone thereof; spring 40 has a second leg 44 on which the bearing surface 31*a*, of the toggle joint 31 is applicable while receiving an upward force f5. The free end 45 of the second leg 44 may come into abutment against the transverse free end 43 of the first leg for disengaging the spring, as will be explained further on with reference to FIGS. 3 and 4.

Figure 1:
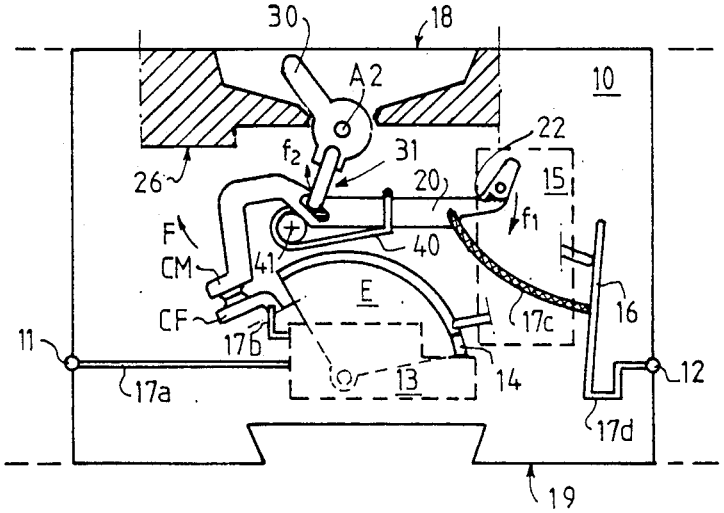
FIG. 1 shows very schematically in an elevational view the main components of a modular circuit breaker in accordance with the invention.

The voluntary tripping lever 30 is mounted for pivoting about a fixed pin A2 between a voluntary engagement position—at the left in FIGS. 1, 2 and 3—and a voluntary tripping position or manual resetting position after tripping on a fault—at the right in FIG. 4. The lever is urged conventionally by a spring which tends to cause it to pivot from left to right as shown by arrow f6 (FIG. 4).

The lock 15 comprises, as already mentioned, a broken link with two levers L1, L2. The pin A1 pivotably mounting the contact holder arm 20 on lever L1 is able to move from a high set position (FIGS. 2 and 4) to a low tripped position (FIG. 3) while being guided in means integrally molded with a side wall of the case 10 and des cribes more fully in connection with FIGS. 5 and 6.

Lever L1, comprises a tail 50 on which the bimetal strip 16 may be applied, in the direction of arrow f7 (FIG. 2), should an overload occur, so as to cause the broken link to break. It further comprises a bearing or engagement means 51, for example a step, for receiving a cooperating element, for example a pin 52, of lever L2 in the set position; and a bell mouthed housing 53 formed between step 51 and tail 50 for guiding and receiving pin 52 in the tripped position (FIG. 3).

Lever L1 further comprises a positioning and guide stud 54 in engagement with conformations integrally molded with the side wall of the case, profile 55 for facilitating the initial disengagement of lever Ll during tripping on a fault and a shoulder 56 for cooperating with a coupling piece (see FIGS. 7 and 8).

Lever L2 is mounted for pivoting on a pin A3 fixed with respect to case 10 and has two substantially orthogonal arms 57, 58; arm 57 is associated with the mobile active element 14 of the electromagnetic trip 13 which is, for example, a core, a striker or, in the present example, a part of the insulating arc quenching screen E. Arm 58 has at its end the pin 52.

Preferably, pins A1 and A3 are aligned with the axis A52 of pin 52 in the set position; the alignemnt A1, A52, A3 along a straight line X—X (FIG. 5) is then obtained perfectly since the pins Al and A3 are integrally molded with case 10 and since the stud 54 of lever L1 is applied in the set position against a stop also integrally molded with the case.

It is advantageous for lever L1 to be made from metal and for lever L2 to be molded from a plastic material with insertion of a metal needle for forming the pin 52 intended to cooperate with the metal step 51 of lever L1.

A spring not shown is placed between the contact holder arm 20 and lever L1 for urging this latter in rotation in an anticlockwise direction about pin A1 (arrow f8, FIG. 3). A return spring not shown is associated with lever L2 for causing it to pivot in an anticlockwise direction about A3 (arrow f9, FIG. 3).

FIG. 3 shows the protective apparatus in a position tripped on a fault, the broken link being broken and spring 40 being disengaged; FIG. 4 shows the apparatus in the voluntary tripped position, the contact holder arm 20 being in a position applied against stop 26 in the case after being raised by the toggle joint 31, the broken link L1, L2 remaining intact and spring 40 being again disengaged.

Figure 4A:
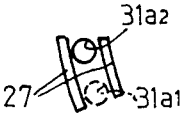

FIG. 4*a* shows guiding of the bearing surface 31*a* of the toggle joint 31 which cooperates with arm 20 against a ramp 27 with two ribs molded into the wall of case 10, for dictating the travel of bearing surface 31*a* between a voluntary engaged position 31al and a voluntary tripping or reset position 31*a*2.

FIGS. 5 and 6 show a ramp 60 formed from a rib integrally molded with a side face of case 10. Ramp 60 forms a channel opened out into a V shape defined by a vertical leg 60*a* and an oblique leg 60*b* for housing and guiding pin A1; ramp 60 also comprises a slanting leg 60*c* joined to vertical leg 60*a*.

Pin 52, the thickness of leg 60*a* and the position of stud 54 of lever L1 applied in abutment against this leg under the effect of the force f8 are determined for perfectly aligning the axes A52 of pin 52, pin A1 housed at the bottom of the V of the channel and pin A3 in the set position in the direction X—X.

When a fault occurs lever L2 is pushed in a clock wise direction (arrow f10, FIG. 6) and releases pin 52 from step 51 of lever L1, so that this latter, driven downwards by lever 20, pivots in a clockwise direction about pin A1, (arrow f11, FIG. 6) through the guiding effect of stud 54 along leg 60*c* as far as the position shown in FIG. 6; pin 52 is then engaged in the bell shaped housing 53 of lever L1.

In FIGS. 7 and 8 it can be seen that lever L1 is associated by means of a coupling piece 70 able to pivot about a fixed axis A4 with an adjacent tripping or signalling apparatus not shown. The coupling piece 70 comprises for this a facet 71 capable of cooperating with a shoulder 56 of lever L1, a drive finger 72 adapted for cooperating with the stud 23 which is provided at the second end 20*b* of the contact holder arm 20. The coupling piece 70 further has a stud 73 integral therewith and projecting transversely through a fixed window 28 provided in a lateral face of the case as input or output means.

During tripping on a.fault effecting the lock 15, the lever L1—end of arm 20 assembly descends (arrow f1, FIG. 8) under the effect mainly of the spring 40; and stud 23 via finger 72 drives the coupling piece 70 which then pivots in a clockwise direction (arrow F12, FIG. 8); the coupling stud 73 consequently towards the upper end of window 28 and actuatesa corresponding coupling stud of the adjacent apparatus.

When the adjacent apparatus trips on a fault, it may raise stud 73 in a clockwise direction from the position shown in FIG. 7, so that the coupling piece 70 rotates in the direction of arrow f12 and thus through the facet 71 applied against shoulder 56 causes lever L1 to pivot and the broken link to break.

The circuit breaker shown in the Figures operates in the following way:

in the set position shown in FIGS. 1 and 2, the contact holder arm 20 is disposed substantially parallel to the front face 18 of the circuit breaker and lever 30 occupies the engaged position on the left in the Figures. The mobile contact CM is applied against the fixed contact CF under the effect of the force produced by spring 40 in the direction of arrow f4, whereas the end 20*b* of the contact holder arm is in abutment against the bearing surface 22 of lock 15 whose levers Ll, L2 are in the opened out position.

When an over voltage or a short circuit occurs, the output element 14 of the magnetic trip 13 pushes arm 7 of lever L2 and causes a clockwise rotation of this lever. Pin 52 of arm 58 of the same lever is therefore driven to the right, so that lever L1 is freed and allows the end 20*b* of the contact holder arm to descend. It should be noted that in a first very brief stage the arm pivots about the mobile contact so that the upper end of the guide slot 21 comes into abutment against the bearing surface 31*a* of the toggle joint 31. Thus, arm 20 may pivot in a clockwise direction about the bearing surface 31*a*, the ends 20*a*, 20*b* of the arm coming into the position shown in FIG. 3. Spring 40 is then disengaged since its legs 42 and 44 are then in reciprocal bearing relation.

To go from the opened out position of FIGS. 1 and 2 to the retracted position of FIG. 3, the broken link moves as follows. As soon as pin 52 is released from the step 51, lever L1 slides by its surface 55 on pin A4. The downward movement already described of pin A1 causes surface 55 to be disengaged from pin A4. Stud 54, up to then in abutment against leg 60*a* of rib 60 of the case, descends over the oblique ramp part 60*c* of this rib and forces lever L1 to pivot in a clockwise direction. Because of the simultaneous clockwise pivoting of lever L2 about pin A3 and the presence of the bell mouthed housing 53 in lever L1, pin 52 is engaged at the bottom of this housing. (FIG. 3).

In the case of an overload, the movement of arm 20 is the same as the one which has just been described, but it is lever L1 which causes retraction of the lock. The bimetal strip 16 in fact actuates the tail 50 of lever L1 in the direction of arrow f7 and causes the lever to pivot in a clockwise direction for freeing the step 51 from pin 52.

During voluntary, manual or automatic tripping, lever 30 goes from the position shown in FIGS. 1 and 2 to that shown in FIG. 4. In a first stage, the toggle joint passes beyond its dead point and the bearing surface 31*a* comes to bear against the upper end of the guide slot 21; the leg 44 of spring 40 then exerts on bearing surface 31*a* a force confirming the rotation of the lever in the direction of arrow f6, whereas leg 42 of the same spring continues to exert its force in the direction of arrow f4 on arm 20.

With the end 20a of arm 20 bearing on the surface 22 of pin Al held fixed, further rotation of the lever therefore causes opening of the mobile contact. Spring 40 is disengaged by abutment of its leg 44 against its leg 42 and movement of lever 30 and arm 20 under the effect of the spring belonging to the lever continues until shoulder 25 provided at the end 20a of the arm is applied against stop 25.

The circuit breaker is reset, from the position shown in FIG. 4, by rotating lever 30 in the anticlockwise direction. Bearing surface 31*a* is applied 44 of spring 40; this leg is freed from the other leg 42 which may then exert on arm 20 the desired closure force. The contact holder arm pivots in an anticlockwise direction about the bearing surface 22 of pin A4 and the mobile contact is applied and remains applied against the fixed contact by spring 40.

After tripping on a fault, resetting is automatic; with the parts of the apparatus occupying the position shown in FIG. 3, the lever is brought to the right so that after the toggle joint 31 has gone beyond its dead point, bearing surface 31*a* raises the contact holder arm 20 until the shoulder 25 of the arm is in abutment against the stop 26 of the case. Further rotation of the lever towards the right causes an anticlockwise pivoting movement of the arm about the shoulder 25/stop 26 fulcrum. The broken link opens out under the effect of the spring causing L2 to pivot in the direction of arrow f9 and of the spring causing L1 to pivot in the direction of f8. Stud 54 of lever L1 rises while sliding along the ramp part 60*c* and comes against the vertical stop 60*a*, so that pin 52 is positioned in the step 51 on the axis X—X. The link is then set.

It goes without saying that modifications may be made to the embodiment described without departing from the scope and spirit of the invention.

What is claimed is:

1. An electric circuit breaker having a switch mechanism comprising:

i. a stationary contact and a movable contact adapted to cooperate together to make the circuit through the breaker in a closed position of said contacts and break the circuit in an open positon of said contacts;

ii. an elongate movable contact holder arm having first and second ends and first and second bearing surface portions, the first end than the second surface portion, the movable contact being carried at the first end, the movable contact arm having an ON position in which the contacts are closed and first and second OFF positions in which the contacts are open;

iii. overload current responsive tripping means including a lock forming a retracting fulcrum taking an unretracted position when the tripping means is untripped and a retracted position when the tripping means is tripped due to an overload;

iv. a toggle joint mechanism including:

a manually operable actuating member pivotably mounted about a fixed point and having ON and OFF positions;

a link connected to the actuating member at a first end of said link, said link having a second free end;

v. a torsion spring mounted on a fixed axis and having a first leg on which said free end bears when the movable contact holder arm is in its ON position, the first leg then acting against said link, and from which said free end is disengaged when the actuating member is in its OFF position while the movable contact holder arm is in either one of its first and second OFF positions, said torsion spring further having a second leg which bears on the second bearing surface portion of the movable contact holder arm in the ON position of said movable contact holder arm while first and second legs have free ends which are mutually abutting to disengage the second leg from the movable contact holder arm in either one of the first and second OFF positions of said movable contact holder arm;

vi. the free end of the link being in such cooperating engagement with the first bearing surface portion of the movable contact holder arm that said movable contact arm will be pivoted about said free end through action of the first leg of the spring from its ON to its second OFF position when the retracing fulcrum passes from its unretracted to its retracted position, and vii. the movable contact holder arm being pivoted about the retracting fulcrum when said retracing fulcrum is inits unretracted position and the actuating member is pivoted to its OFF position.

2. A circuit breaker as claimed in claim 1, wherein said switch mechanism is mounted in a casing which has a guide ramp for said free end of the link and said movable contact holder arm has a guiding slot for said free end.

3. A circuit breaker as claimed in claim 1, wherein said lock comprises a broken link having set and unset positions, said broken link comprising first and second levers in mutual astable engagement and said movable contact holder arm is pivotably connected at its second end to said first lever by means of a pin, whereas said second lever is mounted for pivoting with respect to a fixed pin, said first lever comprising a tail, urgeable by a thermal tripping element, said second lever comprising an arm urgeable by an electromagnetic tripping element.

4. A circuit breaker as claimed in claim 3, wherein said first lever is provided with a positioning stud cooperating with a fixed stop, said first lever further forming a fulcrum for a further pin associated with the second lever, so that in the set position of the broken link the axis of said further pin is aligned with the axis joining together the pin of the first lever and the fixed pivoting pin of the second lever.

5. A circuit breaker as claimed in claim 4, wherein said positioning stud cooperates during tripping of the broken link from the set to the unset position with a ramp part allowing said first lever to free itself from the thermal tripping element.

6. A circuit breaker as claimed in claim 5, wherein said first lever is provided with a shaped surface portion arranged opposite the fulcrum with respect to the pin of the first lever and bearing on a fixed bearing surface as soon as tripping of the broken link begins.

7. A circuit breaker as claimed in claim 4, wherein one of the levers of the broken link is made from a plastic material and has an inserted metal needle forming said pin, the other lever of the broken link being made from metal.

* * * * *